US007945976B2

(12) United States Patent
Rice

(10) Patent No.: US 7,945,976 B2
(45) Date of Patent: May 24, 2011

(54) LIVING WATER SYSTEM PAD AND METHOD FOR ITS USE

(76) Inventor: Russell Rice, Del Mar, CA (US)

( * ) Notice: Subject to any disclaimer, the term of this patent is extended or adjusted under 35 U.S.C. 154(b) by 589 days.

(21) Appl. No.: 12/035,315

(22) Filed: Feb. 21, 2008

(65) Prior Publication Data

US 2009/0120502 A1 May 14, 2009

Related U.S. Application Data

(60) Provisional application No. 60/986,562, filed on Nov. 8, 2007.

(51) Int. Cl.
*A47C 27/08* (2006.01)

(52) U.S. Cl. ..... 5/421; 5/423; 5/706

(58) Field of Classification Search ..... 5/421, 423, 5/706, 710

See application file for complete search history.

(56) References Cited

U.S. PATENT DOCUMENTS 2,136,043 A 11/1938 De Laney
2,982,841 A 5/1961 MacCracken
3,894,213 A 7/1975 Agarwala
3,967,627 A 7/1976 Brown
4,149,541 A 4/1979 Gammons et al.
4,159,728 A 7/1979 Kraus et al.
4,459,468 A 7/1984 Bailey
4,635,620 A 1/1987 Ricchio
4,974,272 A 12/1990 Liu
5,033,136 A * 7/1991 Elkins ..... 5/421
5,500,007 A 3/1996 Kim et al.
5,603,131 A 2/1997 DeJean, Jr.
5,634,225 A * 6/1997 Miller et al. ..... 5/710
5,643,336 A 7/1997 Lopez-Claros
6,079,068 A 6/2000 Viard
6,094,762 A 8/2000 Viard et al.
6,385,803 B1 5/2002 Viard
6,568,006 B1 5/2003 Hyland

* cited by examiner

*Primary Examiner* — Fredrick Conley

(74) *Attorney, Agent, or Firm* — Buche & Associates, P.C.; John K. Buche

(57) ABSTRACT

A pad circulation system, comprising a pad, tubing that is operationally configured to affix to said pad, at least one container, wherein each container is operationally configured to hold water or other liquid, a pump, said pump capable of circulating said water or other liquid throughout said tubing.

10 Claims, 3 Drawing Sheets

LIVING WATER SYSTEM PAD AND METHOD FOR ITS USE

CROSS-REFERENCE TO RELATED APPLICATIONS

Applicant hereby cross-references and claims the priority filing date of related U.S. Provisional Application No. 60/986,562, filed Nov. 8, 2007 in the name of Applicant Russell Rice.

STATEMENT REGARDING FEDERALLY SPONSORED RESEARCH OR DEVELOPMENT

Not applicable.

BACKGROUND OF THE INVENTION

1. Field of the Invention

The present invention relates to heating and cooling pads and mattresses using water to regulate temperature within a pad, and more particularly pertains to a living and open water system which re-circulates water through a pad. The open and mutable nature of this invention allows users to not only access and change the water and regulate its temperature, but personalize each treatment with additions of crystals, blessings, aroma therapy and other variants.

2. Description of the Prior Art

The use of water to heat and cool pads or mattresses is known in the prior art. More specifically, pads or mattresses devised and utilized previously are closed system pads containing air or other materials to surround tubes conducting heated or cold water through the inventions. These inventions consist of familiar, expected and obvious structural configurations which have been developed for the fulfillment of countless objectives and requirements.

Known prior art includes: U.S. Pat. No. 6,568,006, which describes a heated air mattress with tubing disposed within its interior for circulating heated waters to heat the mattress; U.S. Pat. No. 4,149,541, which describes a fluid circulating pad with waffle-like channels for circulating heated or chilled water; U.S. Pat. No. 5,500,007, which discloses a water bed base with heating pipes that circulate water from a tank with an electric water heater, and U.S. Pat. No. 5,643,336, which describes a therapeutic pad with tubing for re-circulating a fluid from a closed reservoir.

While the prior art devices referenced herein fulfill their respective, particular objectives and requirements, the aforementioned patents disclose closed systems that utilize the circulating fluid solely for temperature control, so that access to the fluid is not required, nor even easily permitted. Furthermore, that these are closed systems makes it difficult to quickly change the fluid that is being circulated, for example, when rapid temperature changes are desired or when other characteristics of the fluid are desired.

Many practitioners of holistic and alternative health treatments believe that water possesses vibrational energies, or signatures, that can be conveyed to living organisms, such as the body, when the water is taken internally, placed in contact with the skin, or circulated near the body, as in a pad for a massage table. It is believed that certain of these vibrational energies possess a particular spin that can carry unhealthy messages, producing negative effects such as inducing stress, while the opposite spin can remove stress and enhance health. The latter type of water is often referred to as "living water," which is created by processes such as exposure to high levels of positive energy, thereby canceling out any negative signatures, or by placing crystals or minerals in the water.

This inventive device includes a layered pad that has affixed to it a series of water tubes secured by a fastener, like the ubiquitous fabric hook and loop fastener system (such as Velcro®) to the bottom of said pad. The ends of the tubes project outward and are fluidly connected to a water pump. This pump is capable of being placed in any of a plurality of water containers, typically constructed of ceramics or materials exhibiting similar characteristics. The water containers are removable for cleaning. Although at least one water container is contemplated, the present embodiment exhibits three separate water containers. A box which may be used to hold said containers, may be wired with a safety switch or timer on the first water holder to prevent overheating if the water contained therein evaporates. A separate water container may be utilized as a holding container for the water pump when it is not being used. Said box may have a power switch with an on/off toggle to control the water pump. Yet another container may have controls for heating the water contained therein and may also have low, medium, high and off settings. The variety of positions for the water pump allow for the user to choose between cold, hot, or otherwise treated water and control the exact temperature to suit the needs of the person receiving therapy.

This invention is distinguishable from standard heating pads or mattresses in that it is: (1) not electrically heated—a means of heat disliked due to the electromagnetic fields generated which disrupt the users' energy fields, and (2) not a closed system incapable of being cleaned, monitored and personalized. Prior art closed water system pads or mattresses have the inherent problem of not remaining sterile, becoming contaminated with and harboring bacteria, and quickly degenerating due to the expansion and contraction caused when water flow is either started or stopped. The prior art also suffers from the limitations of being incapable of easy maintenance and is limited in its variety of use. Finally, an air-filled mattress utilizing a closed system with an electrical heat source would suffer practical limitations, since it would be prone to the previously mentioned problems. Furthermore, air temperature is more difficult than water to vary and/or maintain at constant levels due to its physical characteristics. In these respects, the living water system pad substantially departs from the conventional concepts and designs of the prior art and, in so doing, provides an apparatus primarily developed for the purpose of providing a therapeutic and warm or cold open water system pad that is both easy to use and maintain.

SUMMARY OF THE INVENTION

In view of the foregoing disadvantages inherent in the known types of water heated or cooled mattresses and pads, the present invention provides a new living and open system water temperature regulated pad with a variety of practical applications for use with a massage table or in a variety of other settings.

The general purpose of the present invention is to provide an open, living water pad circulation system capable of heating and cooling, and of being used in a variety of applications. This invention has many novel features that result in a new living water pad circulation system(s) which is not anticipated, rendered obvious, suggested or even implied by any of the prior art mattresses or pads, either alone or in any combination thereof.

To attain this, the present invention generally comprises of an upper pad separably secured above a second lower pad.

When separated, a series of water tubing is revealed lying on top of the lower pad. This tubing is secured to the lower portion of the pad via use of a series of fasteners such as Velcro® straps and loops around to fully cover the pad area. The tubing may vary in length, diameter, width, and flexibility, depending on the size of the mattress pad, but is curled in consecutive "S" shapes to traverse as much of the mattress pad's inner surface area as possible. The present embodiment uses a tube length which varies typically from five (5) feet to fifty (50) feet in length curled within the pad (depending on pad size and area), has an external diameter of typically three-eighths (⅜) inch and has an internal diameter of one-fourth (¼) inch. Said tube typically enters the pad through an opening at the base of the living and open water system pad, however alternative embodiments may contemplate a pad whereby the tube enters at other locations, such as the top, bottom, or any side of the pad. The tube is fluidly coupled to a water pumping device that carries water from at least one water container. Said container(s) may be made of ceramic, pottery or any variety of materials with similar characteristics and may vary in number. Said container(s) may also be held in a box or frame with a plurality of corresponding chambers (depending on the number of containers used), and may be made in a variety of shapes and sizes. Applicant also contemplates a water-level sensor (either located on the box or any other suitable location), whereby said sensor will interrupt the pumping of water should the water evaporate, leak, overheat or otherwise become depleted, thereby creating a danger of pump overheating and of becoming a fire hazard. Applicant also contemplates a power outlet and on/off toggle switch (either located on the box or any other suitable location) related to the water pump that is fluidly coupled to the water tubing. Applicant also contemplates a control switch (either located on the box or any other suitable location) for heating water in one of the containers, whereby the water contained therein may be adjusted to various temperatures by directing said control switch to high, medium, low, off, or similarly designated positions. By adding water to these containers, the user may not only modify the temperature, but also add scents, crystals or other materials the user deems necessary for the therapy being provided.

Although the present embodiment displays a system for use on a mattress pad for use on a massage table or similar surface, Inventor also contemplates alternative embodiments of this system utilizing smaller pads. For instance, the open water pad system could be used in conjunction with very small pads capable of delivering treatment to specific locations on the body, such as the stomach, back and neck. Such pads may vary in size from a couple inches across to several feet, depending on the size of the corresponding area of the body to which treatment will be applied. Likewise, the length and diameter of the tubing used would necessarily vary in conjunction with such alternative embodiments.

Likewise, although the present embodiment displays a pad for use on a massage table or similar surface, Inventor also contemplates alternative embodiments of this system utilizing pads designed specifically for use with bed frames as standard mattress alternatives.

As such, those skilled in the art will appreciate that the principles of the present invention may readily be utilized as a basis for the designing of other structures, and methods for carrying out the multiple purposes of the present invention. It is important, therefore, that the claims be regarded as including such equivalent constructions insofar as they do not depart from the spirit and scope of the present invention.

It is therefore an object of the present invention to provide a living water system pad apparatus and method which has many of the advantages of the mattresses and pads which are heated or cooled by water, and which are mentioned heretofore, but which also make use of novel features, and thereby result in a new living water system pad not anticipated, rendered obvious, suggested, or even implied by any of the prior art mattresses and pads, either alone or in any combination thereof.

It is another object of the present invention to provide a new living water system pad which may be easily and efficiently manufactured and marketed.

It is a further object of the present invention to provide a new living water system pad which is of a durable and reliable construction.

An even further object of the present invention is to provide a new living water system pad which is capable of a low manufacturing cost(s), with regard to both materials and labor, thereby resulting in lower wholesale and retail pricing, thereby making the living water system pad economically available to the buying public. The maintenance and replacement parts of this invention also typically are low-cost and will be economically available to the buying public.

Still another object of the present invention is to provide a new living water system pad which provides some of the advantages available in the apparatuses and methods of the prior art, while simultaneously overcoming some of the disadvantages normally associated therewith.

Still another object of the present invention is to provide a new living water system pad which provides heated or cooled water via tubing into an open system pad capable of being maintained and utilized in a variety of fashions by the consuming public.

Yet another object of the present invention is to provide a living, open water system that can be utilized in a pad that is sized for a massage table or a variety of mattresses, pads, clothes or other variants able to support an open water system that provides either heat or cooling for a variety of therapeutic uses.

Still yet another object of the present invention is to provide a living open water system pad is that warms or cools a person laying thereon and comforts their body.

These, together with other objects of the invention, along with the various features of novelty which characterize the invention, are pointed out with particularity in the claims annexed to and forming a part of this disclosure. For a better understanding of the invention, its operation advantages and the specific objects attained by its uses, reference should be made to the accompanying drawings and descriptive matter in which there are illustrated various embodiments of the invention.

It is to be noted, however, that the appended drawings illustrate only typical embodiments of this invention, are not to scale, and are therefore not to be considered limiting of its scope, for the invention may admit to other equally effective embodiments which are appreciated by those skillful in the arts.

BRIEF DESCRIPTION OF THE DRAWINGS

The invention will be better understood and objects other than those set forth will become apparent when consideration is given to the following detailed description thereof. Such description makes reference to the annexed drawings wherein.

DETAILED DESCRIPTION OF THE INVENTION

Figure 1:
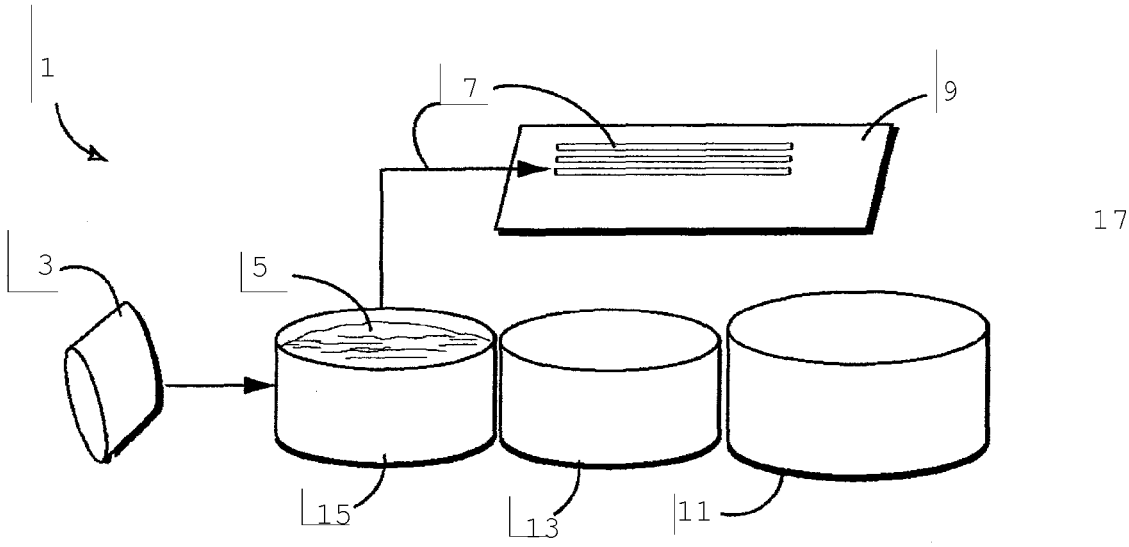
FIG. 1 is a functional block diagram of a living water system pad according to the present invention.
Figure 2:
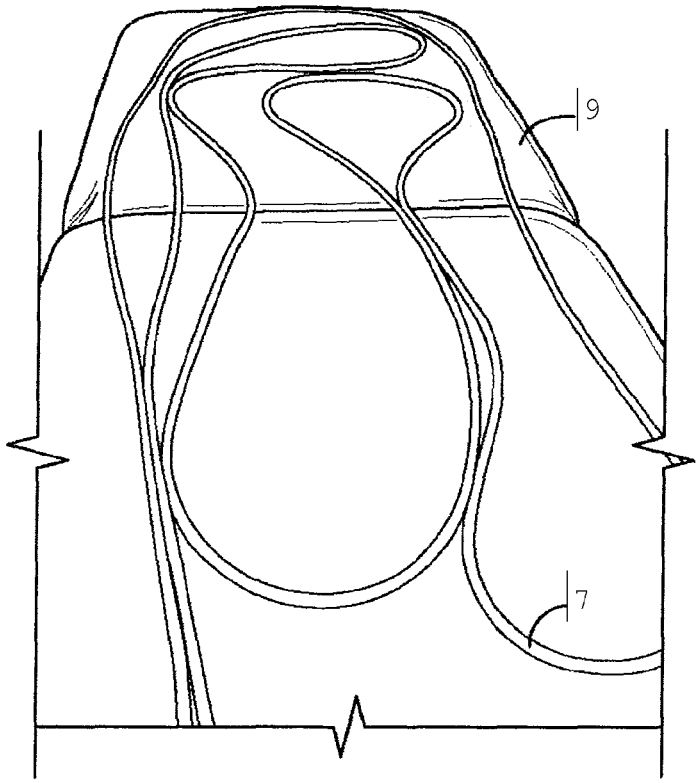
FIG. 2 is a perspective view of the invention, illustrating the fluid conducting tubing on a massage table.

With reference to FIGS. 1-5, a new living water system pad embodying the principles and concepts of the present invention and generally designated by the reference numeral 1 will be described.

Beginning with FIG. 1, the living water system pad 1 generally comprises a device for positioning on a conventional massage table 9 or other supporting system. Typically, a massage table 9 has a platform and a plurality of legs. Water 5 in the tubing 7 flows from the pump 3 that can be placed in a frame 17 that has three (3) containers 11, 13, 15 or any more or less combination thereof. The pump 3 may be removably placed in one of containers 11, 13, 15 within a frame 17. While three containers 11, 13, 15 are illustrated, different numbers may be used, with the frame 17 being adjusted accordingly. In an exemplary embodiment, a first, heated water container 15 sits on or in a heating device (not shown), such as a ceramic heater, to heat the water 5 contained in said heated water container 15. The second of the three containers 11, 13, 15 presently shown is the cold water container 13, and thus requires no heating device as with the first container 13. The third of the three containers 11, 13, 15 presently shown is a changing container 11 which provides a back-up reservoir into which the pump 3 can be temporarily placed while changing water in the either the heated water container 15 or the cold water container 13.

It should be noted that the use of waters of two different temperatures, as described above, is merely an example. Water having a variety of characteristics may be used, as well as a multiplicity of containers for each additional water characteristic desired. For example, crystals or a positive energy source may be placed into one or more of the containers. Positive energy sources for producing "living water" are known in the art and are generally commercially available from massage and alternative health product providers. During the massage, the therapist can switch to different types of water depending on the desired effect by simply moving the pump 3 to a different container. Additionally, one alternative embodiment may utilize a separate pump for each container, and one or more valves may be incorporated in the tubing to switch from one source to another with minimal interruption. Such alternative embodiments would be readily apparent to those skilled in the art.

A water level detector (not pictured) can be provided to deactivate the pump in case the water in a container becomes depleted or evaporates. The power cord 37 typically plugs into a standard 120VAC outlet to provide power to the heating device and pump(s) 3. Preferably, an on/off switch (not shown) is provided to control power to the components within said frame 17 and a temperature controller is provided to set the heating device to attain the desired water temperature.

Figure 4:
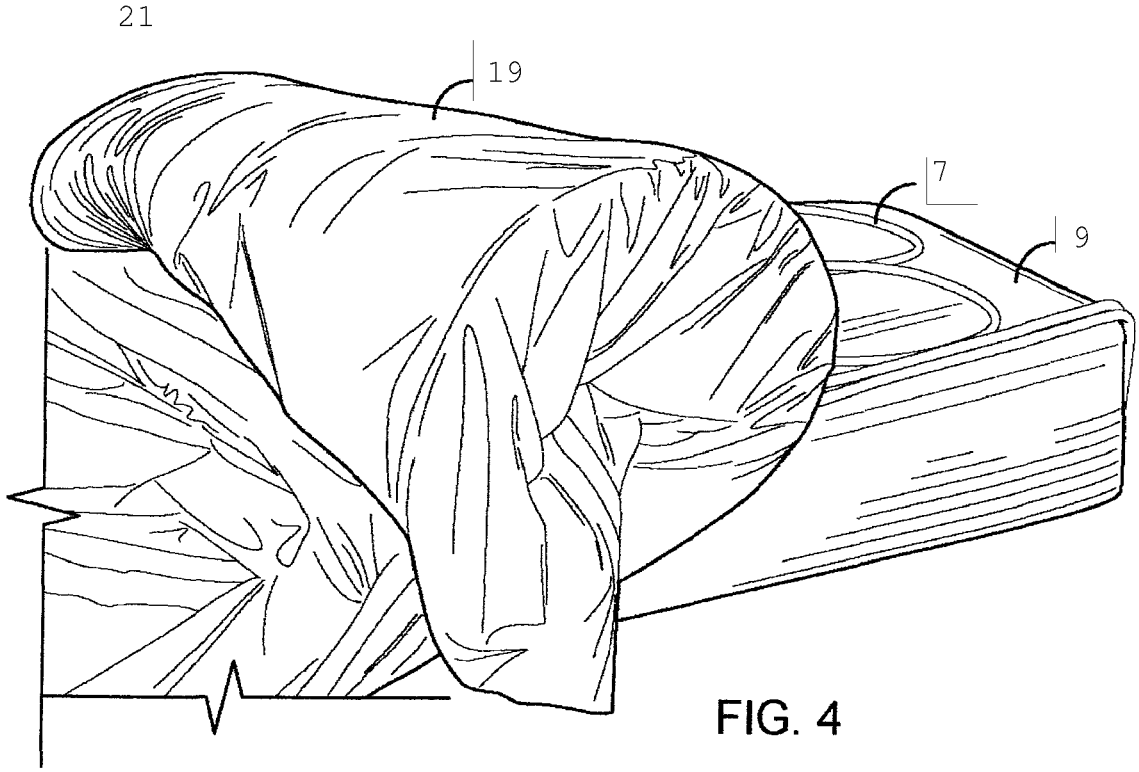
FIG. 4 is a perspective view of the invention, illustrating the heater or cooling tubing under a pad situated on a massage table, with the pad partially lifted.
Figure 5:
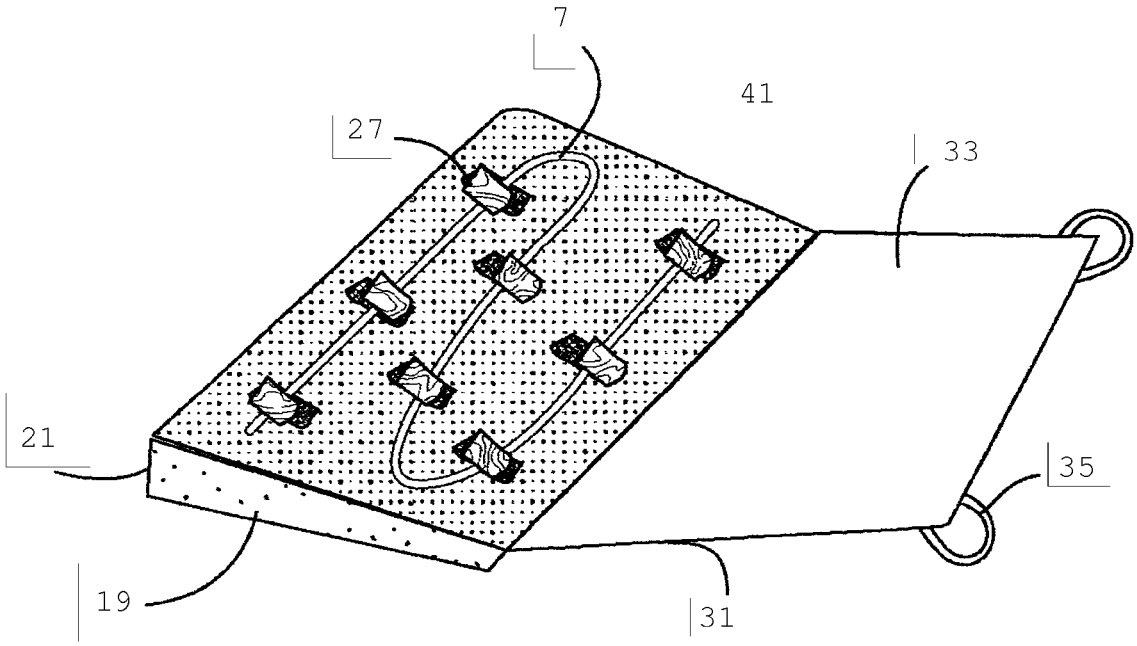
FIG. 5 is a perspective view of a pad according to the invention.

In an exemplary embodiment, the living water system pad 1 includes a layered pad 19 that is disposed on top of the massage table platform. FIG. 4 displays the pad 19 as it is used in conjunction with the typical massage table 9. The pad 19 typically includes a flexible upper layer 39, which contains foam or other resilient cushioning material enclosed within an outer pad cover 21, typically made of a washable material such as a light canvas, that may also include means for attaching a sheet or other textile cover. As shown in FIG. 5, the pad 19 may include table straps 35 to secure the pad to the massage table 9.

Figure 6:
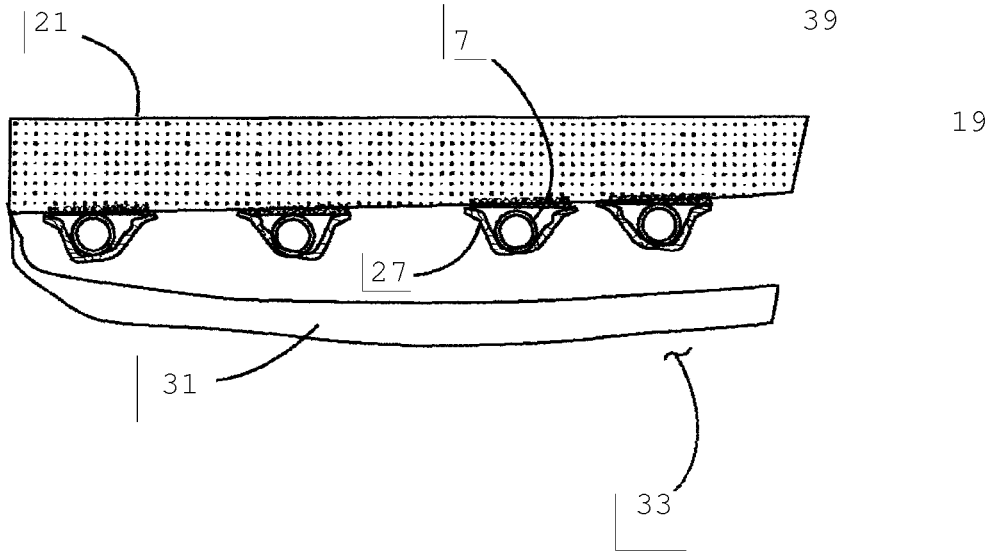
FIG. 6 is another view of the pad depicted in FIG. 5.

Together, FIGS. 5 & 6 embody one manner in which the tubing 7 may connect to the pad 19. Within or attached to the pad bottom cover 33 of the pad 19 is flexible water tubing 7 that loops around to substantially engage the pad 19 area. The pad 19 typically has a bottom surface 41, which has a plurality of tubing fasteners 27 fixedly attached thereon for said tubing 7 connection. Said tubing fasteners 27 are typically comprised of hook and loop fasteners (such as Velcro®), ties, snaps, buttons, or any other fastener which will be readily apparent to one skilled in the art. Said tubing fasteners 27 may alternatively attach to the pad bottom surface 41, rather than to the actual pad 19 itself. The pad bottom surface 41 is typically made of canvas, thin plastic, vinyl sheeting or any other material known to those in that art with similar characteristics and which will lay flat across the massage table 9. The upper layer 39 and pad bottom surface 41 may be attached along at least one side to enhance stability, as illustrated in FIG. 5, or they may be separable, with each layer being separately attached to the table by straps, hook and loop fasteners (Velcro®)) or other appropriate fasteners so that they are firmly held when the table 9 is in use.

Said water tubing 7 may typically be forty (40) to fifty (50) feet in length in order to traverse the full surface area of a typical massage table 9 and/or pad 19. However, Applicant contemplates a variety of tube lengths, depending on the table 9 size, pad 19 size, and/or the individual therapist's preference as to the amount of surface area covered by tubing. The tubing 7 is also typically three-eighths (3/8) inch external diameter and one-fourth (1/4) inch internal diameter, formed from PVC, polyurethane, silicone or other appropriate material with similar qualities. However, Applicant contemplates the use of tubing 7 of various diameters and thicknesses, depending on such factors as desired water flow volume, circulating of undissolved particulates in the water from added elements, such as crystals, or any other reason known to those skilled in the art.

Figure 3:
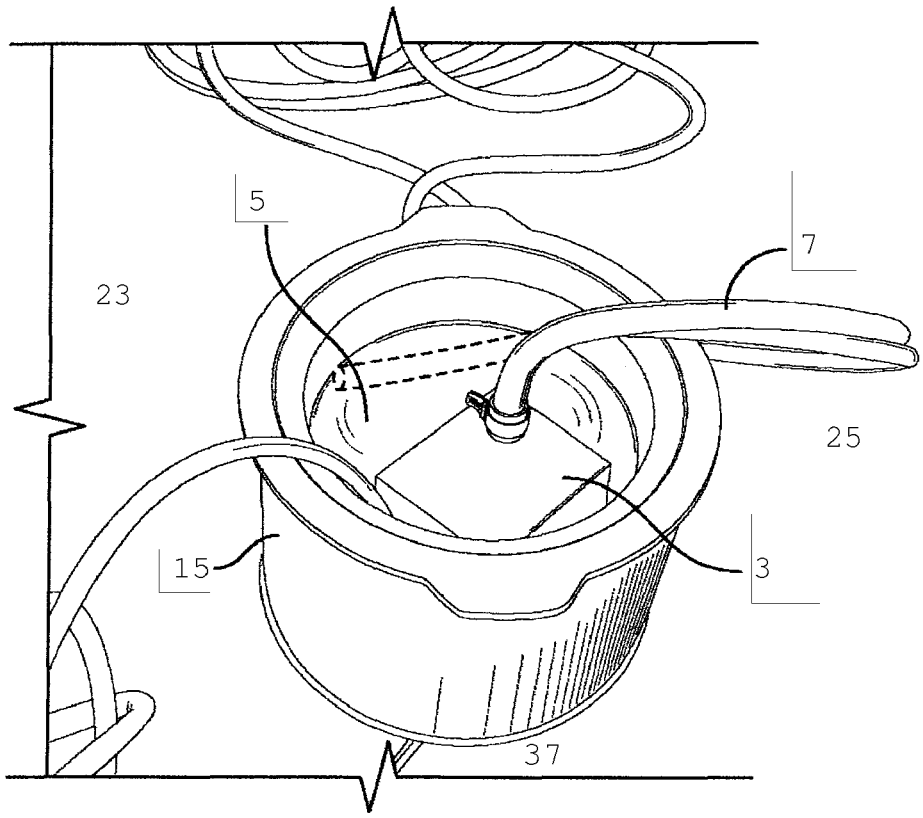
FIG. 3 is a perspective view of a fluid container, tubing and pump of the device.

As shown in FIG. 3, the tubing 7 is attached to a conventional recirculating pump 3 that is removably placed in one of the container 11, 13, 15. The outlet end 23 of tubing 7 is placed within the same container that the pump is in. As shown in FIGS. 5 & 6, the tubing fasteners 27 allow the tubing 7 to be removed and replaced, providing for easy maintenance.

In addition to avoiding the drawbacks of prior art closed systems, the open containers 11, 13, 15 provide the advantages of being able to easily add materials, such as minerals, crystals or other beneficial materials, during use, as well as quickly changing from water having one characteristic to water having a different characteristic, with minimal disruption to the therapy.

In summary, the living water system pad 1 functions by positioning said pad 19 on a massage table 9. Said water pump 3 may be placed into any of a plurality of containers 11, 13, 15 containing cold, hot, or otherwise treated water 5, in order to circulate said water into the water tubing 7. Said water tubing 7 is removably attached either to or within the pad 19 by a plurality of tubing fasteners 27, typically located on the pad bottom surface 41. Said tubing 7 is connected to said pump 3 via a fluid coupling. The water 5 will then circulate from whichever container 11, 13, 15 contains the pump 3, with said water 5 moving through the tubing 7 within the pad 19, or attached to said pad bottom surface 41 to apply the desired therapeutic characters of the flowing water 5. The living water system pad 1 may be used with or without the massage table 9.

In review, disclosed is a pad circulation system, comprising a pad, tubing that is operationally configured to securely fix to said pad, and wherein said tubing has first and second ends. Said pad circulations system further comprising at least one container, wherein each container is operationally configured to hold water or other liquid, a pump, wherein said pump is operationally configured to circulate said water or other liquid throughout said tubing, wherein said pump is removably connected to said first end of said tubing, and, wherein said pump and said second tubing end are removably placed in one of said containers containing said water or other liquid. Additionally, said pad may comprise a plurality of layers, including an upper layer and a lower layer, wherein said upper layer comprises a resilient cushion and wherein said lower layer further comprises a material capable of attachment to a top surface of a massage table. Further, said pump is movable to said different containers, whereby recirculating said water or other liquid contained therein is accomplished with only nominal interruption, and wherein said containers may be open. The water in said pad circulation system may be comprised of water with different characteristics selected from the group consisting of chilled, heated, or warm, from the group consisting of various crystals, minerals, and positive energy sources, and/or other groups of desirable liquids which will known to those skilled in the art. Said containers may also be disposed on a heating device capable of heating said water contained therein. Said pad circulating system may be operationally configured for removable attachment to a variety of typical massage tables. Said tubing of said pad circulating system may be disposed on said lower layer of said pad and removably attached to said pad via a plurality of tubing fasteners, which may be any common type of fasteners including a fabric hook and loop fastener system.

Further disclosed is a method for circulating water or other liquid through a pad circulation system, comprising the steps of removably placing a pump in any of a plurality of open containers, said open containers containing water or other desired liquid, connecting one end of tubing to said pump, placing a second end of said tubing in said container, removably attaching said tubing to a pad in a manner sufficient to traverse the desired surface area of said pad, placing said pad on a massage table or other surface suitable for providing therapeutic massage, turning on said pump to start circulating the water contained in the container in which said pump is placed. Further disclosed is the step comprised of removing said pump and placing it in any other of a plurality of containers containing heated, cooled, or otherwise treated water, whereby said water is recirculated. Further disclosed is the step comprised of heating one or more of said containers such that said contained water becomes heated. Further disclosed is the step comprised of cooling one more of said containers such that said contained water becomes cooled.

With respect to the above description, then, it is to be realized that the optimum relationships for the parts of the invention include variations in size, materials, shape, form, function and manner of operation. Assembly and use are deemed readily apparent and obvious to one skilled in the art, and all equivalent relationships to those illustrated in the drawings and described in the specifications are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalent may be resorted to, falling within the scope of the invention.

I claim:

1. A pad circulation system, comprising:

a pad with a plurality of layers;

said pad having an upper layer, said pad having a lower layer, wherein said lower layer further comprises a material capable of attachment to a top surface of a massage table;

tubing disposed on said pad to engage and fix said pad to said tubing, said tubing having first and second ends, a plurality of tubing fasteners, wherein said tubing is removably attached to said pad via said plurality of tubing fasteners, wherein said tubing fasteners are comprised of a fabric hook and loop fastener system;

at least one container, wherein each container is capable of containing water or other liquid, wherein said contained water or other liquid has different characteristics, wherein said at least one container(s) are open;

a pump, wherein said pump is capable of circulating said water or other liquid throughout said tubing, wherein said pump is removably connected to said first end of said tubing, wherein said pump is movable to said different containers, thereby recirculating said water or other liquid contained therein and having different characteristics, wherein said pump and said second tubing end are removably placed in one of said containers containing said water or other liquid.

2. The pad circulation system of claim 1, wherein at least one of the containers is disposed on a heating device capable of heating said water contained therein.

3. The pad circulation system of claim 1, wherein said pump is movable to said different containers, thereby recirculating said water or other liquid contained therein, with only nominal interruption.

4. The pad circulation system of claim 1, wherein said tubing is operationally configured to substantially cover the surface area of said pad.

5. The pad circulation system of claim 1, said upper layer comprising a resilient cushion.

6. The pad circulation system of claim 1, said upper layer further comprising a cover.

7. A method for circulating water or other liquid through a pad circulation system, comprising:

Removably placing a pump in any of a plurality of open containers, said open containers containing water or other desired liquid;

connecting one end of tubing to said pump;

placing a second end of said tubing in said container;

removably attaching said tubing to a pad in a manner sufficient to traverse the desired surface area of said pad;

placing said pad on a massage table or other surface suitable for providing therapeutic massage;

turning on said pump to start circulating the water contained in the container in which said pump is placed.

8. The method of claim 7, further comprising the step of removing said pump and placing it in any other of a plurality of containers containing heated, cooled, or otherwise treated water, whereby said water is recirculated.

9. The method of claim 7, further comprising heating one or more of said containers such that said contained water becomes heated.

10. The method of claim 7, further comprising cooling one more of said containers such that said contained water becomes cooled.

* * * * *